US005161109A

United States Patent [19]

Keating et al.

[11] Patent Number: 5,161,109

[45] Date of Patent: * Nov. 3, 1992

[54] UP/DOWN LOADING OF DATABASES

[75] Inventors: Raymond Keating, Purdys, N.Y.; Ronald P. Sansone, Weston; Karl H. Schumacher, Westport, both of Conn.

[73] Assignee: Pitney Bowes Inc., Stamford, Conn.

[ * ] Notice: The portion of the term of this patent subsequent to Dec. 31, 2008 has been disclaimed.

[21] Appl. No.: 285,145

[22] Filed: Dec. 16, 1988

[51] Int. Cl.[5] ..... G07B 17/02

[52] U.S. Cl. ..... 364/464.02; 364/478; 395/600

[58] Field of Search ..... 364/900, 464.02, 478; 395/600

[56] References Cited

U.S. PATENT DOCUMENTS

| | | | |
|---|---|---|---|
| 4,084,242 | 4/1978 | Conti | 364/464.03 |
| 4,097,923 | 6/1978 | Eckert, Jr. et al. | 364/900 |
| 4,122,532 | 10/1978 | Dlugos et al. | 364/900 |
| 4,241,405 | 12/1980 | Allocca | 364/466 |
| 4,713,761 | 12/1987 | Sharpe et al. | 364/406 |
| 4,797,830 | 1/1989 | Baggarly et al. | 364/464.03 |
| 4,831,554 | 5/1989 | Storace et al. | 364/464.02 X |
| 4,832,204 | 5/1989 | Handy et al. | 235/385 X |
| 4,873,645 | 10/1989 | Hunter et al. | 364/464.02 X |
| 4,908,761 | 3/1990 | Tai | 364/402 X |
| 4,908,770 | 3/1990 | Breault et al. | 364/464.02 |
| 4,959,795 | 9/1990 | Christensen et al. | 364/464.03 |
| 5,077,694 | 12/1991 | Sansone et al. | 364/464.02 X |

*Primary Examiner*—Thomas G. Black
*Assistant Examiner*—Edward R. Cosimano
*Attorney, Agent, or Firm*—Peter Vrahotes; Melvin J. Scolnick

[57] ABSTRACT

A communication system for processing information for distribution, including: a central data station, a plurality of user stations, a communication link interconnecting the user stations with the central data stations, each the user station including means for accessing the central station, the central station including a data base of distribution information, the user station including means for accessing the central data station data base, the central data station including means responsive to the user usage pattern for providing data to the station which optimizes rate and time of distribution.

7 Claims, 7 Drawing Sheets

UP/DOWN LOADING OF DATABASES

BACKGROUND OF THE INVENTION

This invention relates to mail processing, and specifically to improvements in mail processing systems, which will relieve central postage facilities of certain mail handling tasks.

The United States currently has the world's largest postal system. The U.S. Post Office currently handle in excess of 100 billion pieces of mail per year, about half the total volume handled throughout the world. The servicing of mail delivery involves three essential steps; collection, sorting and delivery. Collection takes place through a series of post offices spread throughout the United States. The United States has about 30,000 post offices that provide mail services in addition to 9,000 smaller postal centers which provide some kind of some type of mail service. Postal employees typically take letters and packages from mail box facilities to the nearest local office where they are accumulated for the sorting procedure. At the post office, postal clerks remove collected mail from sacks, bundle packages and segregate mail by size and class into separate categories. The mail travels by truck from local post offices to a central facility known as a sectional center. The United States has 264 sectional centers, some of which serve hundreds of local post offices. The sectional center processes nearly all the mail coming or going from its region. At the sectional center, high speed automated equipment sorts large volumes of mail. The postal service currently uses two sorting systems. One system is devoted to letters and other first class mail, and the other system, for bulk mailing, is used to sort packages, magazine advertising, circulars and other large mails. The letter sorter process involves manually moving mail sacks onto moving conveyor belts, which carry the mail to a machine called an edger-feeder which sorts it according to envelope size. The postal service regulates the size of envelopes to make such mechanical sorting easier. The edge-feeder feeds the letters into another machine known as a facer-cancellor. Sensing devices of the facer-cancellor determine where the stamp is located on the envelope, plus enabling the machine to arrange the letters so that they all face in the same direction. The canceling portion of the mechanism then cancels the stamp by printing black lines and the like over it so that it cannot be used again. The machine also prints a postmark on the envelope, including the date, the name of the sectional center, an abbreviation for the state and a three, four or five-number zip code. In addition, the postmark records the time period during which the letter was received at the post office. A computerized machine known as a zip mail translator sorts the postmarked letters according to their destination post office. Postal workers selectively activate the machine's keyboard to send each letter on a conveyor belt into one of hundreds of bins. Each bin holds mail for a different post office. Mail addressed to locations outside the regions served by the sectional center are transported by truck, airplane or train to other sectional centers for further sorting. Finally, postal clerks hand sort mail for the area served by the sectional center into bundles for each delivery route. The zip mail translators in some postal areas have been replaced by more advanced computerized machines called optical character readers which read the zip code on the letter, and pass the mail to another machine that places a series of marks known as bar codes onto the envelope. Additional mechanisms read the bar code and sort mail according to the regions indicated by said bar code. Mail addressed to locations within the regions served by the section center is sorted again by other bar code readers according to destination post office and then according to delivery route. An expanded nine-number zip code, chiefly for use by high-volume mailers, enables the post office to substantially reduce some of these essential time consuming and extensive sorting services. The same processes apply to sorting bulk mail. Current estimates indicate that the foregoing processing tasks necessarily involve in excess of half a million employees. Cost of maintaining and supporting sorting services at the central post office facilities, even including large scale use of automated equipment, has become staggering. Projections of substantial increases in volumes of mail being transporting through central facilities, even with the advent of private delivery, telecommunications services, facsimile services and the like indicate a rapid expansion will be required of such facilities. Since the postal service is a private corporation and is expected to become self-supporting, rapidly advancing postal rates place greater and greater burdens on both users and the postal service in order to support such volumes of mail. In recognition of the capabilities of certain high volume users to provide services to central postal facilities, which services may improve efficiency and reduce the amount of processing time required by the central serving facilities, the US Postal Service offers substantial reductions in rates, provided that a user complies with certain requirements which will allow the US Postal Service to take advantage of certain user-provided facilities to reduce its own work load. The concept of work sharing, wherein a user provides certain of the processing activities prior to delivering the mail to the central postal facilities has been proposed and is therefore a positive innovation in the field of mail processing which may have a substantial impact in the future implemention of mail services.

However, placing a burden on the user to provide certain of the facilities and services which the US central post office facilities now provide is an equally heavy burden for the user, and must be done in a manner which permits the user to realize substantial savings with its own increased work load by taking advantage of the reduced postal service rates while not exceeding the reduction in rates by the serving costs of providing such services on its own.

The Postal Service has already recognized the ability of users to preprocess certain kinds of mail and will accept mail in bulk delivered from a processor along with certification that its procedures have been complied with, and will accept such certification as prima facia justification for reduction in postal service rates. Thus, for example, manifest systems, wherein a manifest is provided to the central post office representative of a group of documents preprocessed by the user, are already known and do allow the user to realize a substantial reduction in rate. However, a large number of additional services, aside from manifesting services, may also be provided by the user and accepted as such by the central processing facility of the postal service in exchange for rate reductions. These additional services, however, require interface communications between the central service and the user so as to maintain within the user's facility information regarding internal postal procedures, such as rates, volume, quantity discounts and the like in order for the central post office facility to accept as valid a certification by the user that certain procedures mandated by the Postal Service have been complied with. The automation of such processing, through the use of telephone or other data communication links, is essential to the successful operation of such a system.

It is therefore the principal object of the present invention to provide a system and apparatus within a user facility which will both operate and maintain, in current fashion, certain preprocessing facilities which can be certified and accepted as properly performed via such certification by the central processing facilities of the US Postal Service in order to qualify for substantial reductions in rate by the use of bidirectional communication links, and in so doing to utilize the communication link to augment and update data base facilities at the user and base stations so that facilitation of user limited facilities may be expanded beyond the user capacity by interaction with the larger central station.

BRIEF DESCRIPTION OF THE PRIOR ART

Prior systems relating to work share features are discussed in copending applications, Ser. No. 285,146 now U.S. Pat. No. 5,019,991, and Ser. No. 234,977 now U.S. Pat. No. 5,005,124, filed Dec. 12, 1988, and Aug. 23, 1988, respectively and assigned to the assignee of the present invention, and U.S. Pat. No. 4,713,761, also assigned to the assignee of the present invention. The applications relates to the concept of using certain limited user provided services but do not encompass the full range of work sharing and data sharing services concepts presented herein. The U.S. patent relates to accounting and billing and does not solve the problem of relieving the postal service of substantial service burdens in an effective manner.

SUMMARY OF THE INVENTION

The present invention relates to a method and apparatus for work sharing including information sharing between participants as well as self-contained automated processing facilities relative to specific requirements set forth by the postal service along with certification of compliance with such requirements acceptable to the Postal Service.

Specific certification requirements include analysis by the user of mail composition, currently known as 3602 Information, in accordance with the specific form currently employed by the post office facilities for such information, such composition including weight, volume, classifications, carrier route information, zip code, appropriate bar code, designations, and rate as described in THE UNITED STATES POSTAL SERVICE DOMESTIC MANUAL, Sections 145.33 and 145.55 (Dec. 17, 1989). In addition, other services such as extended presort coding addressing, accuracy of presorts, classification of mailpiece type for machine readability accuracy of weight and volume in accordance with predesignated discount rates set by the Postal Service in accordance with such factors, and ultimately payment and billing, are all facilities which may be incorporated within a user facility. Incorporation of such information within a user facility, coupled with intercommunication capability between such user facility and a central postal facility, gives certain additional advantages to both user and postal facility which are inherent in the nature of information processing. Thus, the user facility may keep track for accounting purposes of its mailing and other processing as well as funding and volume uses, while the Postal Service may employ intercommunication with many of these user units to forecast workloads, transportation requirements, the management of asset inventory, the creation of mailer profiles, and other information which may be employable to establish process controlling to better manage the U.S. Postal Service resources. In addition, by making certain requirements of the user equipment, the requirement of range of operation of the central service facility equipment may be substantially narrowed. Thus, common fonts may be provided through user equipment which will reduce the requirement of central service facilities to have multiple font capability in optical character recognition.

The maintenance of a two-way communication link between the central station and each of the user facilities permits the central station to keep a permanent record, available for inspection by the US Postal Service, and which may be employed to confirm uses of any of the local users by cross-check, of each of the elements of data which will be considered essential to any specific user application. Thus, each of the user applications are also designed to apply postage. Central accounting and data facilities may be employed to keep track of each user's postage requirements. This may also employ two-way charging and recharging of local postage meters from the central station, also under authority from the US Postal Service, and as have been previously disclosed in prior art remote recharging systems currently in use. Thus, during the on-line periods, multiple quantities of data may be exchanged between the central station and the local user. Thus, the present invention also provides in one embodiment for the employment of a central station with multiple processing capability, capable of high speed data interchange between pluralities of remote local units and itself, and possessing the further capability internally of correlating data culled from each of the remote users which may be employed both for statistical purposes and for the purposes of moderating usage by each of the local users and for insuring compliance with the latest US Postal Service rules, regulations and certification procedures for work sharing.

The data exchange between the central station and the user station give rise to further novel and unique processing capabilities in accordance with the present invention. The user equipment is periodically interrogated as to the customer usage patterns, mail runs, addressee, zip codes, rate breaks, etc. Based on this usage information, information is down loaded to the user. The down loaded information includes advisory procedures, such as the fact that postal charges for first class mail will increase shortly and that any mail run should be pushed out early, the fact that the user has the ability to avail itself of zip code breaks and other useful information as to mailing habits. In mail addressing, the data base incorporated by the central station also can benefit the user by expansion of the user equipment far beyond its limited nature by taking advantage of the relatively larger data base facilities available at the data center. One particularly advantageous use of the communication capability is the uploading of user mailing lists to a data center. At the data center, the information is processed relative to the data center data base to sanitize the mailing address list. This includes noting improper zip codes, changes in carrier routes, changes in addresses when people move, etc. The information is thereafter down loaded to the user mailing equipment at the user location to allow the generation of sanitized effective mailing lists. This enables the user to have a higher "hit" rate of properly addressed and properly delivered mail. Moreover, the system provides a tremendous advantage to the U.S.P.S. Billions of dollars are spent in redelivering mail which is improperly addressed. Mail can be improperly addressed for a number of reasons including the fact that an individual has moved and the new address data has not been properly entered into the system. By providing this service to the top 500 mailers in the country, which constitutes in the area of 80% of the mail in the country (3rd class), a tremendous amount of expense would be saved by the postal service. Where the mail list user is small, businesses can upload their mailing lists to the data center. The uploaded mailing address are sanitized and processed, and in this instance, the center can provide the actual mailing service for the small business by providing the printing of the necessary inserts, inserting the material into the envelopes and addressing and distributing it. Alternatively, the center can down load the address list to the mail business in the appropriate format. It can be also presort by order with an indication as to the appropriate postage amount. The postage chargeable when the data center provides the mailing service can be directly charged to a user account. Additionally, demographic analysis can be done on the mailing list to identify additional mailers who would fall into similar categories and are not yet being serviced by the small business. Moreover, by demographics analysis, other business opportunities for customers of the type serviced by the small business can be identified and provided to the user. The system would include sufficient security to ensure that the mailing list data for the customer is not improperly utilized.

Communication in contrast may also be by means of a code or other form with the relevant information transmitted in encrypted format. The information may be scanned and used to automatically set the postal equipment at the user site to proper settings, both for postage and for usage scheduling, without direct user intervention, thus enhancing security and efficiency.

DESCRIPTION OF THE DRAWINGS

The foregoing brief description and summary of the invention will become more apparent from the following more detailed description of the invention, accompanied by the attached figures, wherein:

With reference to FIG. 1, a plurality of user stations designated as $U_1$, $U_2 \ldots U_n$, and identified as 10, 12 and 14 are shown. It will be understood that multiple user stations are possible in excess of the three shown, and that these are shown by way of example only. These stations are coupled by means of an interconnection network, illustrated generally as 16, to the data center 18, which in turn may be appropriately coupled by means of a secure line or the like to the US Postal Service 20. The data center is a facility run by a commercial operation, such as Pitney Bowes, Inc., the assignee of the present invention. Each of the blocks 10, 12, 14, 18 and 20 contemplate the use of data processing components, each appropriately interlinked by means of high speed telecommunication links or the like for the purposes of exchanging information. It is also contemplated within the scope of the invention that the US Postal Service will maintain an appropriate computer facility, not otherwise described herein, which will possess the capability of uploading and downloading specific pieces of information upon request by the data center, and relating to appropriate postal rules and regulations which will effect the use of certain discounts in mailing postal rates, as well as other factors necessary for the concept of shared work services which will be certified by each of the individual user stations in order to qualify for reduced rate requirements when mail is received in the US Postal Service facilities. The communication link is also contemplated as a two-way link between units 18 and 20, wherein the US Postal Service will have the capability of monitoring specific operations within the data center in order to ensure that the data center is operational in accordance with rules and requirements which may be imposed by the Postal Service from time to time. The monitoring operation is a periodic unscheduled communication link examination of certain storage areas of accessed memory locations for confirming proper operations. Of course, visual on site inspections and examinations may also be made.

With reference to FIG. 2, a more detailed functional component relationship of the data center is illustrated. Thus, the data center includes a first data channel 30 which includes a CPU 32 having a program memory 34, a keyboard 36 and an appropriate display 38 coupled thereto. Data communication link 40 interconnects CPU 32 to the US Postal Service 20. The user units 10 are coupled via appropriate telecommunication data links 42 to a second data channel 44 which includes a CPU 46, a program memory 48, a keyboard 50 and an appropriate display 52. The CPU is coupled to the data links 42 by means of a multi-channel IO device 54 capable of high speed data communication.

Figure 1:
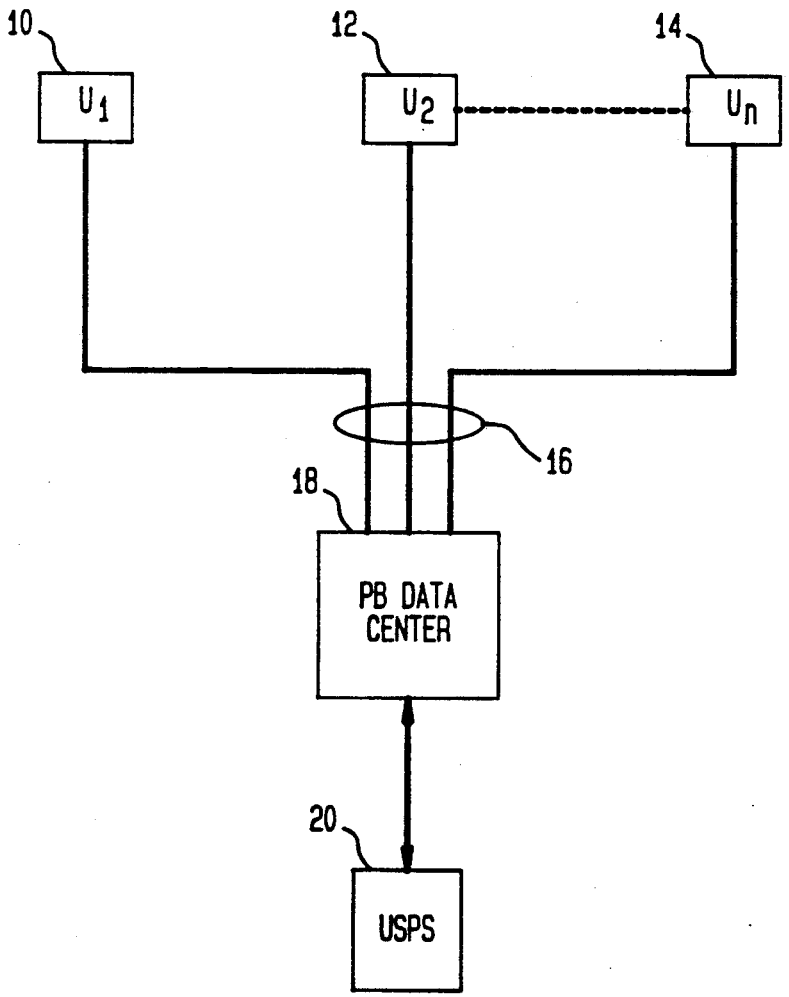
FIG. 1 is a functional block diagram illustrating the relationship between the data center, the U.S. Postal Service, and the local users.
Figure 2:
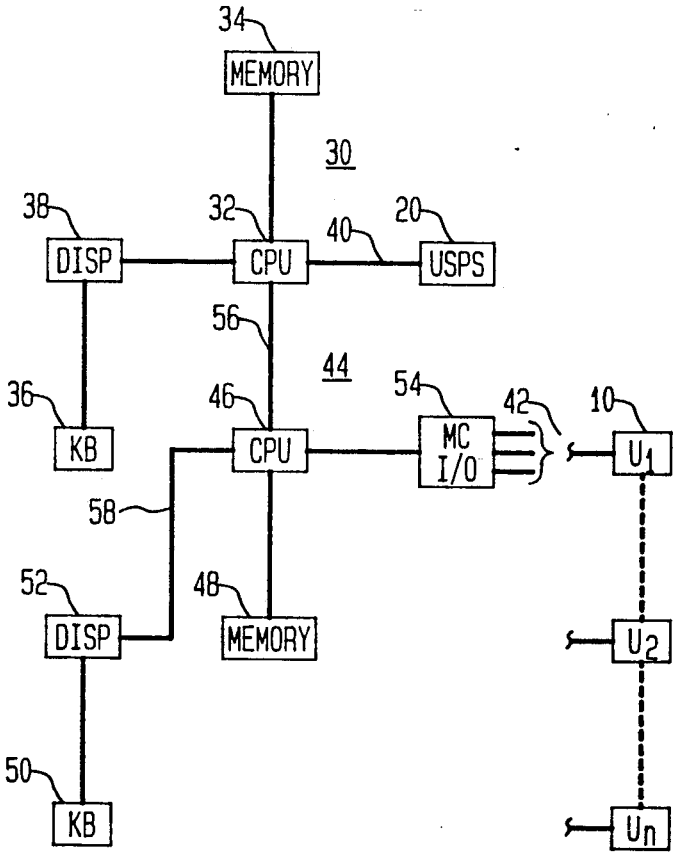
FIG. 2 is a more detailed block diagram illustrating a data center.

In operation, two-way communication between the data channel 30 and the US Postal Service 20 provide a continuous interchange of information regarding updates of US Postal Service rules and regulations required for the continuous certification use by the local users 10. In addition, the data channel 30 may also be manually interrogated by means of keyboard 36 for inquiring of the Postal Service for specific information which may be employed with regard to compliance with certifications, the answering of specific data questions, or other uses requiring specific interrogation by means of the central station to the US Postal Service. Since the US Postal Service link is a two-way communication over channel line 40, it is possible through this link for the US Postal Service to interrogate and monitor the operation of the first data channel 30 and the second data channel 44, for compliance with quality control and other security compliances which may be required by the US Postal Service.

Turning now to the second data channel 44, high speed continuous two-way communication line 56 with respect to continuous update of US Postal Service requirements for certification, servicing and diagnostics, training, and other information interchange, are effected by means of the CPU 46 operating through the high speed data channel 54 interfaced along with communication lines 42 to the multiple user network U1, U2 . . . Un. Operating under control of the program memory 48, the CPU 44 is contemplated as a high speed multiple processing information apparatus of conventional design such as IBM 3083 or a DCVAX unit which may handle multiple requests from any one or more of the users simultaneously through the multiple channel IO device. Keyboard 50 and display 52 may be utilized for manual information interchange between any of the local users and the information operator. Although only a single keyboard display unit is illustrated, it will be understood that dataline 58 is a schematic representation of the existence of a multiple number of display keyboard combinations evidencing the use at the central station of a plurality of key operators available to answer user questions upon interrogation.

Figure 3:
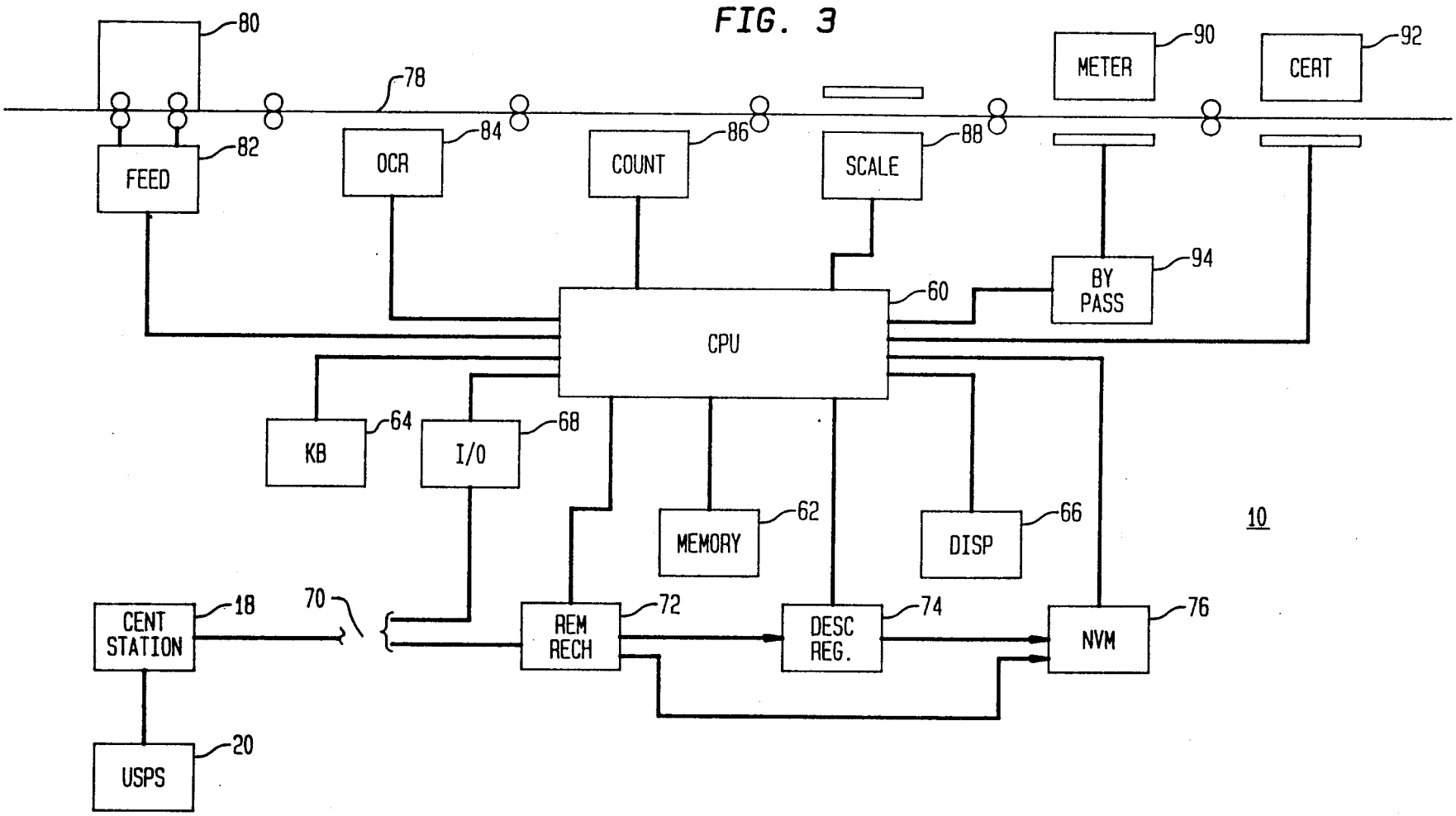
FIG. 3 is a more detailed block diagram illustrating a user station.

Referring to FIG. 3, the function block diagram illustrating the interrelationship of components within each individual user station is illustrated. The central user station operates under the control of a CPU 60, which includes a RAM memory and appropriate control registers. Coupled to the CPU 60 is a program memory 62 which defines the essential functions of the system, including updating instructions and rates used in the local user units, diagnostic monitoring, a two-way communication link establishing a tracking facility utilizing the encryptic key represented by the certification, and interface capabilities with respect to the central station for the downloading of training information which enables operators at local stations to understand and comply with specific requirements imposed by the US Postal Service with respect to the certification process. Coupled to the CPU 60 are a keyboard 64 for the manual entry of data requests and other information into the CPU, display unit 66 and an I/O channel 68 coupled by means of a data link 70 to the central station 18. Accounting information and funding to the local user 10 is effected through the data link 70 from the central station 18 to the remote recharger mechanism 72, operating in accordance with conventional recharging techniques, such is disclosed in U.S. Pat. No. 4,097,923 issued to Eckert Jr. et al., assigned to the assignee of the present application. Remote recharging unit 72 charges a descending register 74, in conventional manner, which keeps track of descending balances charged from time to time in accordance with mail requirements. Non-volatile memory unit 76 is employed to maintain security of information during periods of time when local user unit 10 is not operating. Non-volatile memory 76 receives descending register balances as part of a shutdown routine, along with other security data which may be applied from the active memory of the CPU 60. One of the features of the central unit 10 is that the remote recharging operation carried on in remote recharging circuit 72 is maintained through the data link 70 to the central station 18, and operates independently of the OFF/ON status of the local user unit 10 for monitoring purposes. Thus, even if the local unit 10 is turned off, central station 18 through data link 70 may inquire through the remote recharging unit of the status of certain pieces of information which are maintained either in the RAM memory portion of the CPU 60 during on-times of the unit 10 or in the non-volatile memory 76 during inactive status periods.

The concepts of work sharing entail the performance of certain postal service functions by the user in a secure manner so as to enable the user to apply not only postage but to also apply certification, as an imprint on the mail piece, which will be accepted by the postal service that the services certified were in fact performed by the user and thus enable the user to be entitled to further mail rate reductions. Communication in contrast may also be by means of a code or other form with the relevant information transmitted in encrypted format. The information may be scanned and used to automatically set the postal equipment at the user site to proper settings, both for postage and for usage scheduling, without direct user intervention, thus enhancing security and efficiency.

Certification information is provided to the CPU through a plurality of inputs along a mail path designated as 78. Mailpiece documents which are stacked in appropriate feeder-stacker unit 80 are, under control of CPU 60 through feeder-unit 82, driven along the mail path 78, past OCR unit 84 where printed material on the mailpiece is read, past counter station 86 where individual pieces are counter, to the scale unit 88 where the mailpiece is weighed, and thence to a metering station 90 for application of appropriate postage and finally to a certification station 92 where appropriate certification stamps may be placed on the mailpiece to indicate compliance of the mailpiece with all the criteria that have been set under work sharing requirements required under the US Postal Service regulations. Since the unit may be capable of handling prefranked mail, a meter bypass network 94 operating under control of the CPU, provides for bypassing of the mailpiece of the metering station 90 without the necessary application of additional postage. Problems encountered in short-weight mail may be adjusted by appropriate decrement of the descending register balance in descending register 74 under program control through CPU 60, based upon differences detected by the computer between applicable postage rate requirements and the actual mail run being passed through the user station 10. An example of short-weight mail is disclosed in copending application Ser. No. 285,146, now U.S. Pat. No. 5,019,991, filed concurrently herewith, and assigned to the assignee of the present application.

The data exchange between the central station and the user station give rise to further novel and unique processing capabilities in accordance with the present invention. The user equipment is periodically interrogated as to the customer usage patterns, mail runs, addressee, zip codes, rate breaks, etc. Based on this usage information, information is down loaded to the user. The down loaded information includes advisory procedures, such as the fact that postal charges for first class mail will increase shortly and that any mail run should be pushed out early, the fact that the user has the ability to avail itself of zip code breaks and other useful information as to mailing habits. In mail addressing, the data base incorporated by the central station also can benefit the user by expansion of the user equipment far beyond its limited nature by taking advantage of the relatively larger data base facilities available at the data center. One particularly advantageous use of the communication capability is the uploading of user mailing lists to a data center. At the data center, the information is processed relative to the data center data base to sanitize the mailing address list. This includes noting improper zip codes, changes in carrier routes, changes in addresses when people move, etc. The information is thereafter down loaded to the user mailing equipment at the user location to allow the generation of sanitized effective mailing lists. This enables the user to have a higher "hit" rate of properly addressed and properly delivered mail. Moreover, the system provides a tremendous advantage to the U.S.P.S. Billions of dollars are spent in redelivering mail which is improperly addressed. Mail can be improperly addressed for a number of reasons including the fact that an individual has moved and the new address data has not been properly entered into the system. By providing this service to the top 500 mailers in the country, which constitutes in the area of 80% of the mail in the country (3rd class), a tremendous amount of expense would be saved by the postal service. Where the mail list user is small, businesses can upload their mailing lists to the data center. The uploaded mailing address are sanitized and processed, and in this instance, the center can provide the actual mailing service for the small business by providing the printing of the necessary inserts, inserting the material into the envelopes and addressing and distributing it. Alternatively, the center can down load the address list to the mail business in the appropriate format. It can be also presort by order with an indication as to the appropriate postage amount. The postage chargeable when the data center provides the mailing service can be directly charged to a user account. Additionally, demographic analysis can be done on the mailing list to identify additional mailers who would fall into similar categories and are not yet being serviced by the small business. Moreover, by demographics analysis, other business opportunities for customers of type serviced by the small business can be identified and provided to the user. The system would include sufficient security to ensure that the mailing list data for the customer is not improperly utilized.

Figure 4:
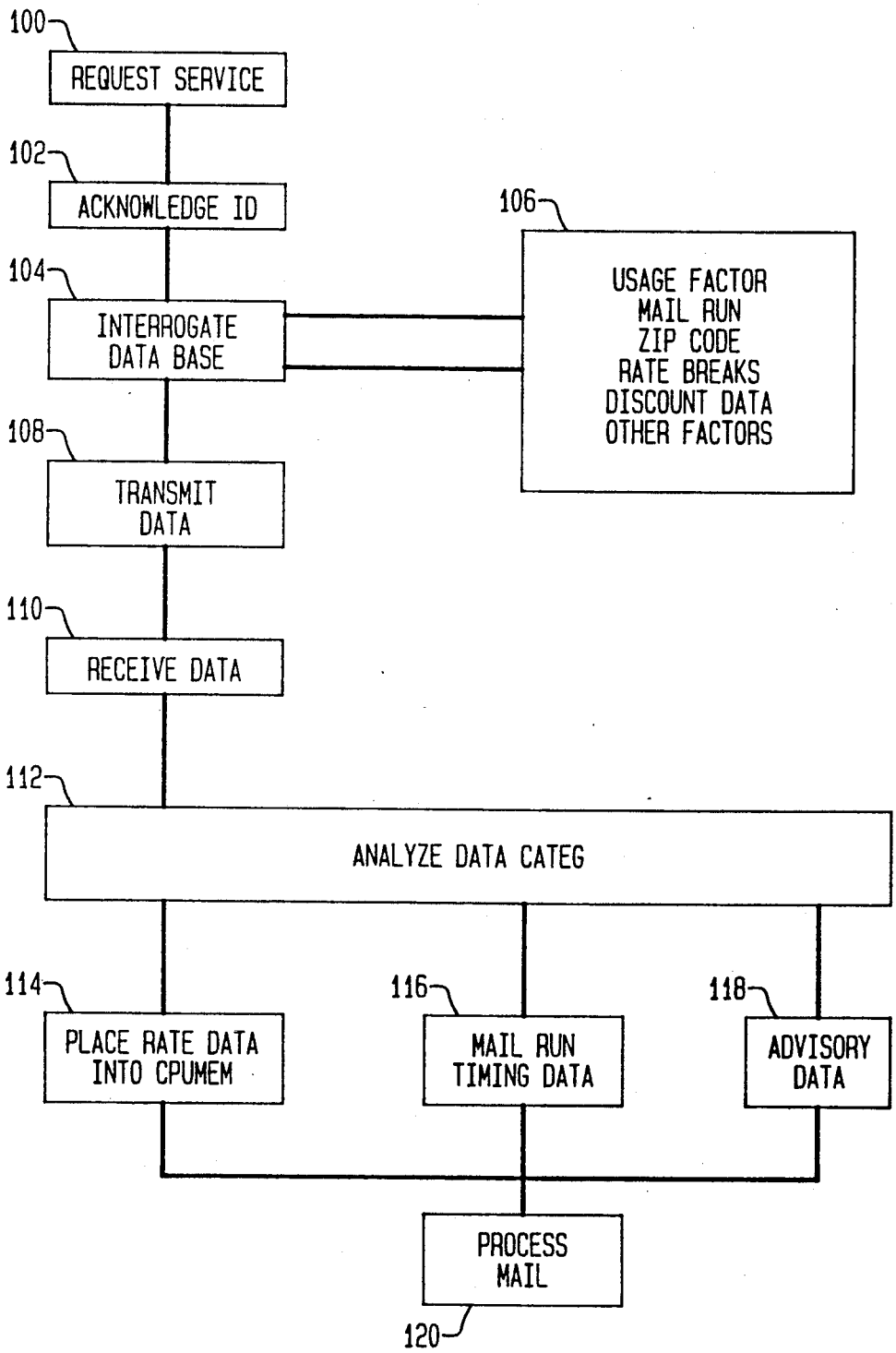
FIGS. 4,*5a*,*5b*,*6a*,*6b*,*7a* and *7b* are flow charts illustrating the operation of FIGS. 2 and 3.

Referring now to FIG. 4, a flowchart illustrating the service described above will now be set forth in greater detail. The flowchart illustrates the operation of the program in the user equipment for effecting interrogation and utilization of the data base provided by the user to a central station, and whereby the central station may provide return data for implementation by the user. Thus, referring to FIG. 4, a request service step 100 is initiated by the user and which is transmitted over the data link to the central station. The central station then provides an acknowledgment signal 102, acknowledging the user by acknowledging the identification signal of the user which was sent with the request service. Next, interrogation of the data base follows 104. The data base 106, which is shown to the right of the interrogate data base step, includes elements of usage such as general usage factors, mail run, zip code, rate breaks, discount data, and other factors unique to a specific user requirement. Next, transmit data step 108 is effected by the user equipment. At this time, the transmitted data is processed by the data center, and analyzed or processed data is then transmitted back to the user, as the received data 110. The user equipment then analyzes the data 112 by specific categories, breaking the categories down into specific pieces of advice or information which may be utilized by the user for various purposes. Thus, the program provides for placing rate data into the CPU memory 114, placing mail run timing data into the CPU memory 116, and placing advisory data into the CPU memory 118. All of these steps are followed by a mail processing step 120, taking into account the foregoing specific categories of advisory information which may have been received from the data center. By using appropriately encrypted command signals over the communication link, the data center can actually cause the setting of the postage metering unit to cause the postage indicated to be applied during a mail run. Accounting can also be effected in known manner by debiting the user account. This step may be included as an option response when the usage data request is made by the user to the data center.

Figure 5A:
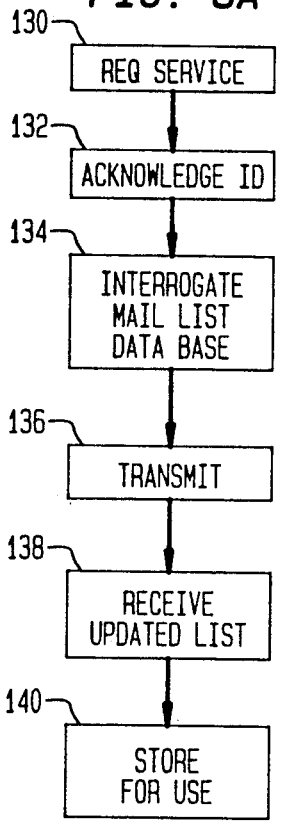
Figure 5B:
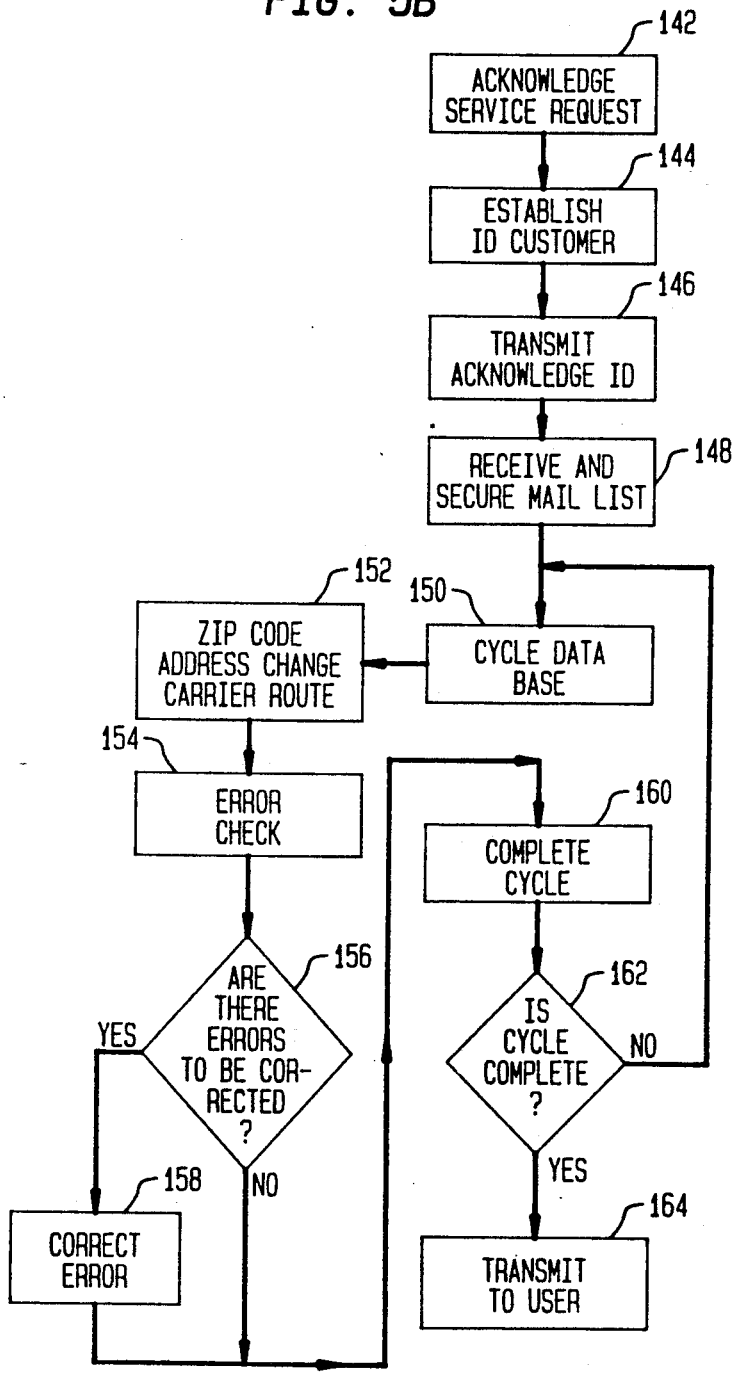

Referring to FIG. 5*a*, a flow chart illustrating the operation of the user equipment for purposes of receiving the sanitized updated mailing list is illustrated. For purposes of explanation, as apparent, FIG. 5*b* shows operations occurring in the data center which interact with the program steps taking place in the user equipment. Thus, referring to FIG. 5*a*, a request service signal is initiated 130 from the user, along with the specific identification signal unique to the user. Next, the user equipment acknowledge receipt of an on line condition from the data center, which acknowledge and thus authenticates its identification 132. Next, the signal acknowledging a ready to receive a mailing list data base is processed by the user equipment, and the interrogated mail list data base is analyzed 134 and transmitted 136 in the next step to the data center unit. The data center unit then appropriately processes the mailing list data 138, as will be set forth in greater detail in conjunction with FIG. 5*b*, and upon completion is transmitted to the user and stored in memory in the received updated list step. The data is then stored for further use 140. Referring to FIG. 5*b*, acknowledgment of the service request 142 from the user is shown in the first process step. The customer identification is established 144 by means of the internal data center data base and a transmit acknowledged identification is sent back to the user 146. Next, the mail list interrogated from the user station as received by the data center and is secured. Various methods to secure information may be applied to secure the data base to insure that a customer's data base will not be accessible by other users or customers. Such security techniques are well-known and are not elaborated in further detail herein, other than to state that such security steps are taken. Next, the data center 18 cycles the data base 150 through various data checks, including zip codes, address changes, carrier routes, and other data which may be relevant to the address lists received from the user station 152. In cycling the data base, the errors which are found are checked 154, and in the decision block 156 following the error check step, any errors which are to be corrected 158 and entered are corrected in the Y path of the decision block 156 to be forwarded to the complete cycle step 162. If there are no errors, the next step is to complete the cycle 160. If the cycle is not completed, as indicated by the N line of the decision block 162 following the complete cycle step, the data base again continues its cycling. Once the cycling steps are completed, then the sanitized data base is transmitted to the user as indicated in the transmit to user step 164.

Figure 6A:
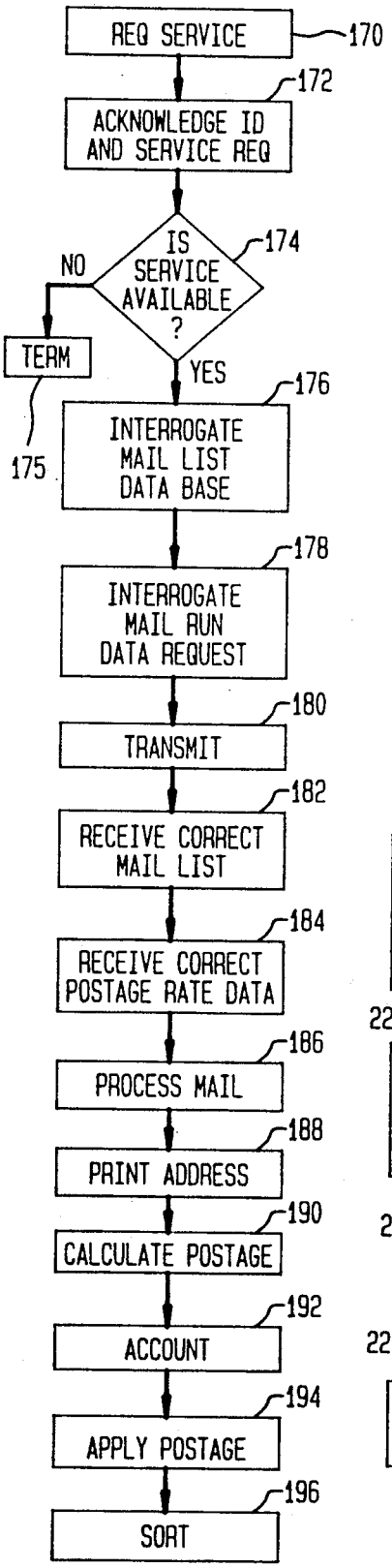
Figure 6B:
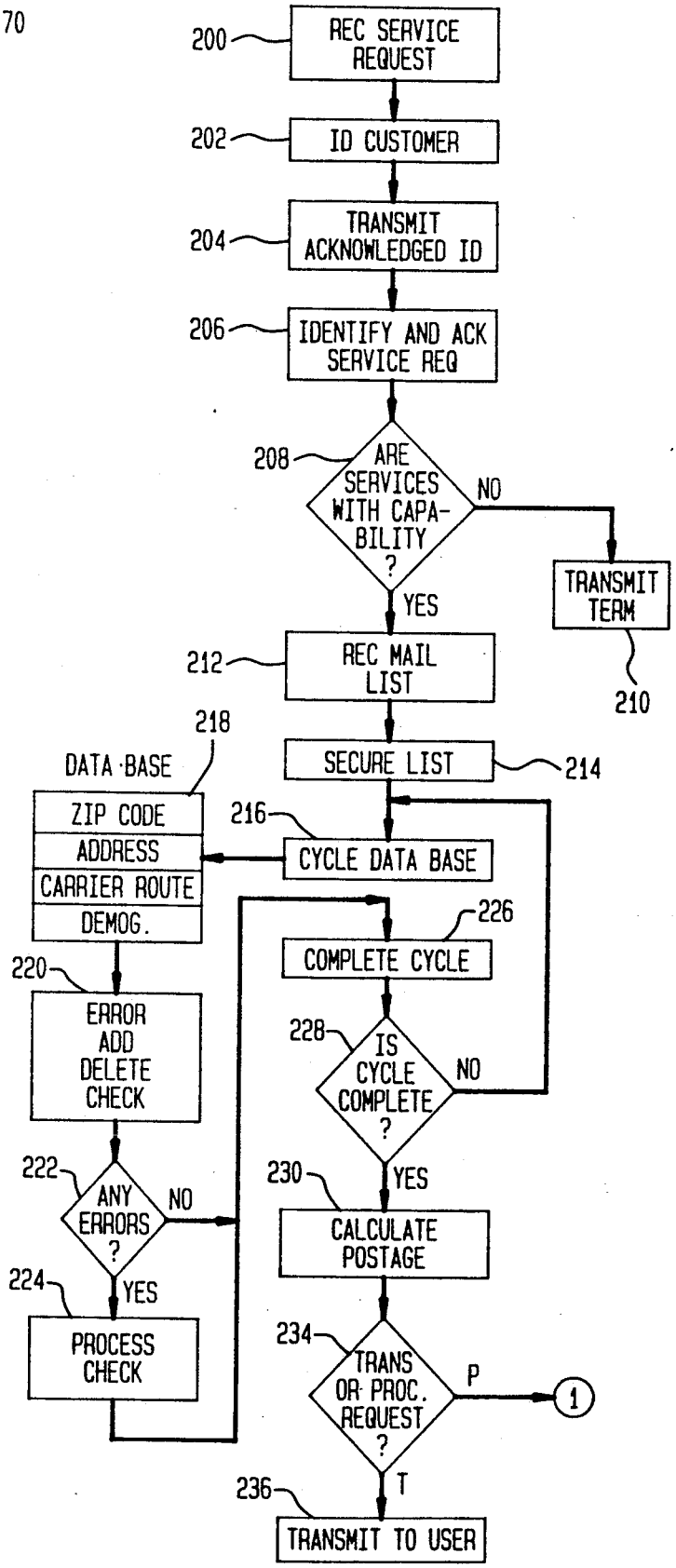

Referring now to FIG. 6*a* and 6*b*, there is shown a flow chart illustrating the manner wherein mailing lists may be actually processed by the central station in addition to being sanitized for user requirements, and can also be employed by the data center for the performance of specific services. Thus, FIG 6*a* illustrates the system flow chart for programming in the individual user station, and FIG. 6*b* illustrates the parallel steps being effected in the central data station in response to the intercommunication of signals from the user station. As shown in FIG. 6*a*, the first step is a request for service 170. Request for service, as set forth above, includes a transmission of an identification code from the user station which may be processed by the central data station for determination of proper customer identification. Next, the acknowledgement of the identification and the specific service requested by the user is received by the user station 172. If the data center indicates that the specific service is not available from the data center, either because of equipment capabilities or because of specific customer user conditions, a decision block 174 following the acknowledgement block indicates, along the no line, a failure of proper acknowledgement and the connection is terminated 175. A positive acknowledgement, however, by the data center, following the Y line of the decision block 174, next results in interrogation of the mailing list data base at the user station 176. Since this specific service will also involve the actual service to be performed by the data center, then the mail run data relative to the mailing list data, is also interrogated by the data center 178 and this data is also transmitted, in the transmit block 180, to the data center. The data center, as will be described with conjunction with FIG. 6*b* hereinafter, processes the data request and retransmits the corrected mailing list 182, in a manner similar to that described in conjunction with FIGS. 5*a* and 5*b*, back to the user. In this particular service requirement, the data center has also calculated the postage rate to be applied to the mail, and transmits such information back to the user 184. Using encryption techniques and a secure environment, it is also possible to provide control signals to actually set the postage meter to the postage setting. Next, the user station then processes the mail 186, prints address indications on the mail in accordance with the sanitized mailing list 188, calculates the postage to be applied to the specific mail run 190, accounts by debiting the user in a known manner for the accounted postage 192, applies the postage to the individual mail pieces 194, and then sorts the mail pieces for ultimate delivery into the mailing system 196. The remote accounting system contemplated herein may be of a type set forth in U.S. Pat. No. 4,097,923 issued to Eckert, Jr. et al. and assigned to the assignee of the present invention.

Figure 7A:
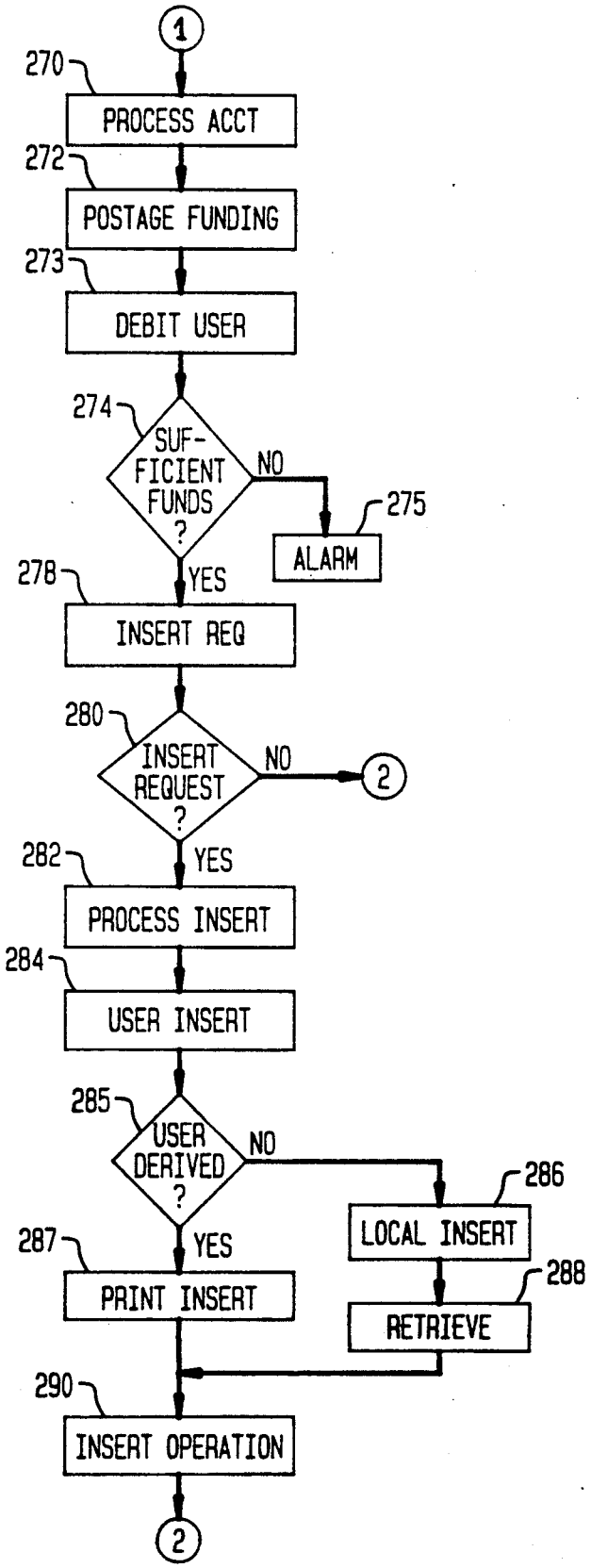
Figure 7B:
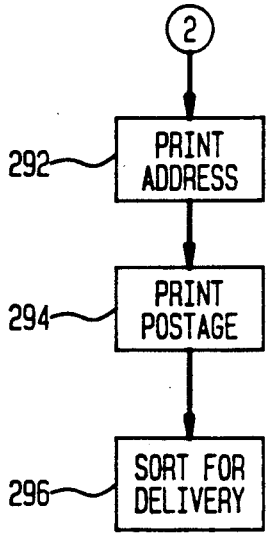

With reference to FIG. 6*b*, the parallel data servicing requirements which are undergone at the data center in response to the specific user program described in conjunction with FIG. 6*a* are set forth. Thus, the first program step is a receipt of a service request 200 over the data transmission link, along with the customer identification. The data center then specifically identifies the customer 202 and transmits an acknowledged identification back to the customer 204. The data center also then identifies and acknowledges the service request received from the customer 206. As indicated in the service block 208 after the identification step, if the services requested by the user are not within the capability of the data center, either to equipment malfunction, insufficient memory, or other equipment problems, a termination transmission is returned to the user and the program ends 210. If however the service request can be honored, as indicated by the Y path of the decision block 208, then next the user station mail list which has been interrogated by the acknowledgement signal response after user equipment is transmitted to the data center in the received mail list block 212. The list is then secured 214 as was set forth in conjunction with the processing in FIG. 5B, at the data base cycle. In this particular processing, the data base is not only cycled by the data center 216 for correctness, as indicated by the data base block which incorporated zip code, address, carrier route, etc. 218, but also for demographics. The function of the additional demographics data base is to add for the user's benefit additional recipients which are related to the specific mail run being effected by the customer. Thus, for example, if all recipients are intended to be middle class income families residing in the city of Chicago who are persons normally involved in purchasing of goods from mail order catalog, then the mail list of the customer may be updated and augmented by including additional names and addresses not currently found within the customer's mail list, but which are present in the data center data base. In the next block, any errors or additions or deletions to the mail list are determined 220. In the event of such conditions, as indicated in the decision block 222 following the error and delete check block, there are processed in the processed check block 224 and then forwarded to the complete cycle step 226. If there are none, then the program branches back to the same point and the cycle continues. The cycle continues to completion as indicated in the complete cycle block 226. If the cycle has not yet been completed after the processed check step, as indicated in the decision block 228 following the complete cycle block, then the program branches back to the beginning of the cycle data base and the cycle data base step continues. If the data base has been completely cycled, then postage for the particular mail run is calculated 230 in the next block and a determination is then made as to whether or not the service request includes retransmission of the data base or processing 234. It will be understood that although the choice is shown as alternative, it may be possible that the mail list would be transmitted back to the user for user benefit and the processing continued. An inquiry is made whether the request is for transmission of data or for processing 234. If the service request indicated a transmission of the sanitized mail list and postage rate data to the user, then the decision so indicates by the T branch and such data is transmitted to the user 236. If the user had requested the data center to process the mail run, then the program branches to program branch line 1 which is continued to FIG. 7*a*. As shown in FIG. 7*a*, the next step in the data center's processing is to process the accounting for postage 270, then to postage funding 272, then to debit the user 273. If the user account is insufficient, as indicated in decision block 274 following the debit user, an appropriate alarm indication is sounded 275. The aforementioned U.S. Pat. No. 4,097,923 discloses a system which may be utilized for this purpose. Assuming the user is appropriately debited, as indicated by the Y line of the decision block 274 following the debit user step, the step proceeds to the insert request step 278. If there is an insert request in the process, indicated by decision block 280 following the insert request, then a insert process takes place 282, if not it will be branched as will be described hereinafter. The insert process may utilize a printing capability at the user station 284. If the insert to be placed is a user derived insert, as indicated by the decision block 285 following the user insert step, then the user station prints the insert 287. If the inserts are previously supplied by the data center, the data center has indicated on the N line of the decision block, then locates the local insert 286, retrieves same 288 and the program branches back to the same point. Next, the insert operation takes place 290. The program then branches along branch line 2, FIG. 7*b*, to the final processing stage which includes the printing of the address 292, the printing of postage 294 and the ultimate sorting for delivery 296. It should be noted that this final printing phase also begins at the decision block 280 following the insert request step 278 if there is no insert request, as indicated by the N line for the decision block into branch point 2.

The foregoing preferred embodiment may be varied within the spirit and scope of the invention, the expression of which is set forth in the appended claims.

What is claimed is:

1. A communication system for expanding user facility capability for processing information relative to mail distribution, comprising: a central data station, a plurality of user stations having usage patterns, and a communication link interconnecting said user stations with said central data station, said central station including a database of mail distribution information, and said central data station including means responsive to said user usage pattern for modifying said database for mail distribution information and providing data to said user stations which optimizes distribution of said mail, said data to optimize distribution includes optimum times to initiate distribution of said article.

2. A system as claimed in claim 1, wherein the data to optimize distribution includes the amount of postage required for proper distribution of said article.

3. A communication system for expanding user facility capability for processing information relating to distribution of mail, comprising: a central data station having a standard database, means for receiving from a plurality of user stations user database information relating to distribution of mail items, means for modifying said standard database located at said central station, and means for modifying said user databases to conform to said modified standard database, whereby said user stations can distribute said mail items in accordance with their said modified databases.

4. A communication system as claimed in claim 3, wherein each of said items are mail pieces, the user data bases, and contains a listing of addresses and zip codes, the standard data base contains a correct up-to-date listing of addresses and zip codes, and the modifying means provides each user data base with corrected listings at a user station.

5. A method of enhancing the efficiency of economy of individual mailers located at separate user stations comprising the steps:

(a) providing a central station computerized database including postal service information relevant to mailers, (b) providing at each mailer location a mailer computerized database, (c) establishing a communication link between the central station and each mailer station allowing access by said central station to respective mailer computerized databases, (d) including in the mailer computerized database one or more data items based on actual mailer experience, (e) said central station periodically accessing selected ones of said mailer locations for accessing the mailer computerized database at each of said accessed locations, (f) placing the accessed data into a database storage area at said central location and processing said accessed data in order to derive information for mailers in connection with one or more of said data items; and (g) said central station transmitting back to said mailers location said derived information.

6. A method as claimed in claim 5 wherein the data items include:

1. usage pattern
2. mail runs
3. list of addressees
4. list of addressee zip codes and
5. rate discounts.

7. A method as claimed in claim 5 wherein the derived information transmitted back includes corrected data items to replace the corresponding data items in the mailer database.

* * * * *